United States Patent [19]

Gowland et al.

[11] Patent Number: 4,732,694

[45] Date of Patent: Mar. 22, 1988

[54] SUDS SUPPRESSOR COMPOSITIONS AND THEIR USE IN DETERGENT COMPOSITIONS

[75] Inventors: Maxim S. Gowland, Keyingham; Stephen A. Johnson, East Boldon; Russell Pell, Kenton Bank Foot, all of England

[73] Assignee: The Procter & Gamble Company, Cincinnati, Ohio

[21] Appl. No.: 881,584

[22] Filed: Jul. 2, 1986

Related U.S. Application Data

[63] Continuation of Ser. No. 639,966, Aug. 10, 1984, abandoned.

[30] Foreign Application Priority Data

Aug. 27, 1983 [GB] United Kingdom ..... 8323131

[51] Int. Cl.[4] ..... C11D 1/17

[52] U.S. Cl. ..... 252/174.21; 252/174.15; 524/588

[58] Field of Search ..... 252/174, 174.15, 174.25, 252/174.13, 91, 358, DIG. 3, 174.21; 524/588

[56] References Cited

U.S. PATENT DOCUMENTS

| | | | |
|---|---|---|---|
| 3,933,672 | 1/1976 | Bartolotta | 252/134 |
| 4,136,045 | 1/1979 | Gault et al. | 252/135 |
| 4,400,288 | 8/1983 | Dhannani et al. | 252/174.15 |

FOREIGN PATENT DOCUMENTS 0008829 3/1980 European Pat. Off. .

*Primary Examiner*—Paul Lieberman
*Assistant Examiner*—John F. McNally

[57] ABSTRACT

A suds suppressor composition comprising, as suds-suppressor, a blend of:

(i) a high shear mix of polydimethylsiloxane (PDMS) and hydrophobic silica, the PDMS having a viscosity of from about 20 to about 12,500 cs, and (ii) PDMS having a viscosity of at least about 25,000 cs wherein the blend has a viscosity of at least about 18,000 cs, the suds suppressor being dispersed in a water-soluble or water-dispersible organic carrier comprising:

(i) from about 1% to about 100% of a first carrier component melting in the range of about 38° C. to about 90° C. and from 0% to about 99% of a second carrier component which is an ethoxylated nonionic surfactant melting in the range from about 5° C. to about 36° C.

The compositions are particularly suitable in high-active containing heavy duty detergent compositions and provide improved foam regulation across the range of wash temperature, product usage, soil, load and rinsing conditions.

6 Claims, No Drawings

SUDS SUPPRESSOR COMPOSITIONS AND THEIR USE IN DETERGENT COMPOSITIONS

This application is a continuation of application Ser. No. 639,966, filed Aug. 10, 1984, now abandoned.

TECHNICAL FIELD

This invention relates to suds-suppressor compositions and to use thereof in detergent compositions. In particular, it relates to heavy duty detergent compositions having controlled sudsing characteristics especially when used in automatic washing machines for washing clothes and the like.

BACKGROUND

Detergent compositions normally contain surfactants which tend to produce foam when agitated in aqueous solution. For many applications, especially in automatic washing and dishwashing machines, excess foam production is a serious problem and with many effective surfactants, it is necessary to add foam suppressing or controlling agents in order to prevent suds-overflow from the machine or under-usage of product by the user. On the other hand, consumers normally expect and prefer a certain amount of foam to be present and, indeed, research has shown that consumers are highly sensitive to a reduction in the foam level pattern. In any particular application, therefore, the optimum degree of foaming will be sufficiently low to avoid oversudsing under all conceivable washing machine temperatures, load and soil conditions, but sufficiently high to meet the consumers preference for a moderate to generous level of foam.

Detergent compositions currently sold for the European domestic automatic washing machine market generally contain up to about 12% of organic surfactant and for such compositions, suds-suppressors satisfying the above constraints are now well established. For example, in No. EP-A-46342, it is taught to use a polydimethylsiloxane/hydrophobic silica suds-suppressor in the form of a dispersion in an ethoxylated nonionic surfactant using certain siloxane-oxyalkylene copolymers as dispersing agent. In No. EP-A-8829, a suds-suppressor is disclosed consisting of a major portion of wax together with a nonionic dispersing agent and hydrophobic silica. No. GB-A-1,407,977 discloses protection of a polydimethylsiloxane/silica suds-suppressor in a water-soluble dispersible carrier.

In detergent compositions containing a high level of surfactant, however, (in excess of about 12%) problems of foam control in front-loading automatic washing machines become increasingly intractible. Thus, the technique of dispersing polydimethylsiloxane/silica in nonionic surfactant is found to become impractical at high levels of suds-suppressor because of diminishing dispersion stability. The wax/silica/dispersant systems are also found to be deficient because of their inherently slow kinetics; in other words, the rate of release of wax/silica fails to match the rate of transport of surfactant to the air/water interface. Conventional polydimethylsiloxane/silica suds-suppressors are also deficient for foam control in high active detergent compositions, presumably because the polydimethylsiloxane is rapidly dispersed or solubilized by the higher surfactant levels. Furthermore, these problems of foam control are found to be greatly exacerbated in concentrated surfactant systems containing $C_{10-16}$ anionic or cationic surfactants which are known to have strong foam-generating characteristics.

The present invention thus provides a suds-suppressor composition suitable for addition to a high active heavy duty detergent composition to provide improved foam control characteristics. It further provides a detergent composition containing a high level of organic surfactant and having improved foaming characteristics across the range of wash temperature conditions. It also provides a high active detergent composition containing $C_{10-16}$ anionic and/or cationic surfactants and having improved foaming characteristics under varying wash temperature, product usage, soil, load and rinsing conditions.

SUMMARY OF THE INVENTION

According to the present invention, there is provided a suds-suppressor composition comprising:

(a) a suds suppressor system comprising a blend of
  (i) a high shear mix of polydimethylsiloxane and hydrophobic silica suds suppressing agents in a weight ratio of polydimethylsiloxane:hydrophobic silica in the range from about 75:25 to about 99:1, the polydimethylsiloxane having a viscosity at 25° C. in the range from about 20 to about 12,500 cs, and
  (ii) polydimethylsiloxane suds suppressing agent having a viscosity at 25° C. of at least about 25,000 cs wherein the blend of high shear mix and high viscosity polydimethylsiloxane has a viscosity at 25° C. of at least about 18,000 cs, the suds suppressor system being dispersed in:

(b) a water-soluble or water-dispersible organic carrier comprising:
  (i) from about 1% to 100% by weight thereof of a first organic carrier component having a melting point in the range from about 38° C. to about 90° C., and
  (ii) from 0% to about 99% by weight thereof of a second organic carrier component selected from ethoxylated nonionic surfactants having a hydrophilic-lipophilic balance (HLB) in the range from about 9.5 to about 13.5 and a melting point in the range from about 5° C. to about 36° C.

The suds suppressor composition thus comprises a blend of two polydimethylsiloxane components, the first component being a high shear mix of polydimethylsiloxane and hydrophilic silica wherein the polydimethylsiloxane has a viscosity of from about 20 to about 12,500 cs, and the second component being polydimethylsiloxane having a viscosity of at least 25,000 cs. The high shear mix is preferably a mixture of polydimethylsiloxane having a viscosity in the range from about 100 to about 4,000 cs, preferably from about 500 to about 2000 cs, with hydrophobic silica in a weight ratio of from about 80:20 to about 95:5. The high viscosity polydimethylsiloxane preferably has a viscosity of at least about 30,000 cs, more preferably from about 50,000 to about 100,000 cs. The blend of high shear mix and high viscosity polydimethylsiloxane, on the other hand, has a viscosity of at least about 18,000 cs, preferably at least about 20,000 cs, more preferably from about 25,000 to about 60,000 cs. The high shear mix and high viscosity silicone are generally blended in a weight ratio of from about 4:1 to about 1:4, more preferably from about 2:1 to about 1:2.

The hydrophobic silica component of the high shear mix preferably has a particle size of not more than about 100 millimicrons, more preferably from about 10 to 20 millimicrons and a specific surface area above about 50 $m^2/g$. The hydrophobic silica can be made, for example, by reacting fumed silica with a trialkyl chlorosilane (i.e. "silanated") to affix hydrophobic trialkylsilane groups on the surface of the silica. The hydrophobic silica is then high shear mixed with polydimethylsiloxane, the latter being end-blocked generally with trimethylsilyl or hydroxyl groups. The polydimethylsiloxane can be prepared by various techniques such as the hydrolysis and subsequent condensation of dimethyldihalosilanes, or by the cracking and subsequent condensation of dimethylcyclosiloxanes.

The high shear mix can be prepared using any conventional high shear mixing equipment. Preferably, however, mixing is performed using an in-line high shear recirculation pump such as a Janke and Kunkel. In practice, the hydrophobic silica is initially dispersed in the polydimethylsiloxane in a reservoir under low shear conditions using, for example a paddle mixer, and the dispersion is then continuously drawn-off and circulated via the high shear pump back into the reservoir until bulk homogeneity is achieved. Shear conditions in the pump are generally such that in a single pass, the temperature of the dispersion leaving the pump is raised from ambient to a temperature in excess of about 95° C., preferably in excess of about 110° C. Although a single pass under high shear turbulent flow conditions is normally adequate, nevertheless, to achieve bulk homogeneity mixing is generally continued until the temperature of the dispersion in the reservoir itself exceeds about 95° C. The viscosity of the dispersion also rises to some extent during the high shear mixing step. Thus in preferred embodiments employing polydimethylsiloxane of viscosity from about 500 cs to about 2000 cs, high shear mixing raises the viscosity into the range from about 6000 to about 10,000 cs.

The suds-suppressor compositions of the invention comprise the suds-suppressor system in the form of a dispersion in a water-soluble or water-dispersible organic carrier. The carrier comprises from about 1% to about 100% of a first carrier component having a melting point in the range from about 38° C. to about 90° C., preferably from about 38° C. to about 60° C., more preferably from about 40° C. to about 55° C., and from 0% to about 99% of a second carrier component selected from ethoxylated nonionic surfactants having a hydrophilic-lipophilic balance (HLB) in the range from about 9.5 to about 13.5 and a melting point in the range from about 5° C. to about 36° C. The weight ratio of the first organic carrier component to suds-suppressor system is from about 10:1 to 1:5, preferably from about 4:1 to 1:2, more preferably from about 2:1 to 1:1. A preferred first organic carrier component comprises ethoxylated nonionic surfactant having an HLB in the range from about 15 to about 19, preferably from about 17 to about 19. Suitable nonionic surfactants are the condensation products of the primary or secondary alcohols having from about 15 to about 24 carbon atoms, in either straight or branched chain configuration, with from about 14 to about 150, preferably from about 20 to about 100, more preferably from about 35 to about 100 moles of ethylene oxide per mole of aliphatic alcohol. Examples of surfactants of this type are the condensation products of hardened tallow alcohol with an average of between about 20 and about 100 moles, preferably about 80 moles of ethylene oxide per mole of alcohol, the tallow portion comprising essentially between 16 and 22 carbon atoms. Other suitable organic carriers include polyethyleneglycols having a molecular weight of from about 400 to about 40,000, preferably from about 1500 to about 10,000, $C_{12-24}$ fatty acids and esters and amides thereof, polyvinylpyrrolidone of molecular weight in the range from about 40,000 to about 700,000 and mixtures thereof. In the case of mixtures, however, the first organic carrier component preferably comprises at least about 35%, more preferably at least about 45% of ethoxylated nonionic surfactant in order to promote transport of suds suppressor to the air/water interface.

The melting point of the organic carrier components is taken herein to refer to the temperature at which melting is completed. Conveniently this temperature can be determined by thermal analysis using a Dupont 910 Differential Scanning Calorimeter with Mechanical Cooling Accessory and R90 Thermal Analyser as follows. A 5–10 mg sample of the material containing no free water or solvent, is encapsulated in a hermetically sealed pan with an empty pan as reference. The sample is initially heated until molten and then rapidly cooled (at about 20°–30° C./min) to −70° C. Thermal analysis is then carried out at a heating rate of 10° C./min using sufficient amplification of ΔT signal (i.e. temperature difference between sample and reference—vertical axis) to obtain an endotherm-peak signal:-baseline noise ratio of better than 10:1. The melting completion temperature is then the temperature corresponding to the intersection of the tangential line at the steepest part of the endotherm curve at the high temperature end of the endotherm, with the horizontal line, parallel to the sample temperature axis, through the highest temperature endotherm peak.

In preferred embodiments, the suds-suppressor compositions of the invention also comprise a siloxane-oxyalkylene copolymer dispersing agent which provides improved homogeneity of the polydimethylsiloxane and silica components within the organic carrier. The dispersing agent is generally added at a weight ratio with respect to polydimethylsiloxane of from about 1:4 to about 1:40, preferably from about 1:6 to about 1:20. The siloxane-oxyalkylene copolymer dispersing agent suitable for use herein has the general formula I:

$$R_aSiY_{4-a} \qquad \text{I}$$

wherein a is O or an integer from 1 to about 3, R is an alkyl group containing from 1 to about 30 carbon atoms, or a group of formula II:

$$R'(OR')_bOR'' \qquad \text{II}$$

wherein R′ is an alkylene group containing from 1 to about 6 carbon atoms, b has a value of from 1 to about 100, preferably from 10 to 30; and r″ is a capping group which can be selected from hydrogen, alkyl, acyl, aryl, alkaryl, aralkyl or alkenyl groups containing up to about 20 carbon atoms, sulfate, sulfonate, phosphate, carboxylate, phosponate, borate or isocyanate groups, or mixtures thereof; Y is a group having the formula III:

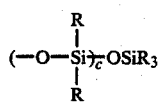

III wherein R is as defined above and c has a value from 1 to about 200; and wherein at least one R group in the compound has the formula II.

Preferred dispersing agents of the above type are selected from copolymers having the general formulae IV to VII:

$$R_a'''Si[(OSiMe_2)_p(OSiMeG)_qOSiMe_2G]_{4-a} \quad IV$$

$$R_a'''Si[OSiMe_2)_p(OSiMeG)_rOSiMe_3]_{4-a} \quad V$$

$$GMe_2Si(OSiMe_2)_p(OSiMeG)_qOSiMe_2G, \text{ and} \quad VI$$

$$Me_3Si(OSiMe_2)_p(OSiMeG)_rOSiMe_3 \quad VII$$

wherein R''' is a $C_{1-10}$ alkyl group, Me is methyl, G is the group of formula II, a has a value of 0 or 1, p has a value of at least 1, q has a value of 0 to about 50 and r has a value or 1 to about 50. Preferred dispersants contain G groups in non-terminal positions and contain a mixture of oxyethylene and oxypropylene groups, particularly in about a 1:1 ratio. Highly preferred are dispersants of formula VII having p+r from about 30 to about 120 with the ratio p:r from about 2:1 to about 8:1.

The suds suppressor compositions of the invention are of two main types—a granular composition wherein the organic carrier consists essentially completely of the first carrier component; and a liquid or liquifiable composition wherein the organic carrier comprises from about 1% to about 50%, preferably from about 2% to about 25% of the first carrier component and from about 50% to about 99% preferably from about 75% to about 98% of the second carrier component. In the latter instance the first carrier component is critical for storage stability of the suds-suppressor composition.

The granular suds-suppressor composition herein preferably also comprises from about 25% to about 95% thereof, more preferably from about 50% to about 85% thereof of a solid water-soluble or dispersible inorganic diluent. Suitable inorganic diluents include alkali metal, alkaline earth metal and ammonium sulphates and chlorides, neutral and acid alkali metal carbonates, orthophosphates and pyrophosphates, and alkali metal crystalline and glassy polyphosphates. A preferred inorganic diluent is sodium tripolyphosphate. Suitable water-insoluble but dispersible diluents include the finely-divided natural and synthetic silicas and silicates, especially smectite-type and kaolinite-type clays such as sodium and calcium montmorillonite, kaolinite itself, aluminosilicates, and magnesium silicates and fibrous and microcrystalline celluloses.

In terms of processing, the granular suds-suppressor compositions are preferably made by forming a melt of the first organic carrier component, adding the high shear mix and the high viscosity silicone, preferably as a premix, to the melt, subjecting the melt to high shear mixing, adding the silicone-oxyalkylene copolymer dispersing agent, and agglomerating the melt with the inorganic diluent in, for example, a pan agglomerator, fluidized bed, Schugi mixer or the like. A preferred inorganic diluent is sodium tripolyphosphate. The particle size of the resulting agglomerate is preferably from about 0.5 mm to about 2 mm, especially from about 0.84 to about 1.4 mm. Critically, the high shear mix of polydimethylsiloxane and hydrophobic silica having a viscosity of from about 20 to about 12,500 cs must be preformed prior to admixture with high viscosity silicone.

The liquid or liquifiable suds suppressor compositions on the other hand, are preferably made by mixing the first and second organic carrier components and, if present, the siloxane-oxyalkylene copolymer dispersing agent, premixing the high shear mix and high viscosity silicone, and high shear mixing the premix with the organic carrier.

The granular suds-suppressor compositions of the invention are normally incorporated in a granular detergent composition at a level of from about 0.1% to about 10%, preferably from about 0.5% to about 5% thereof. The liquid or liquifiable suds-suppressor compositions, on the other hand, are normally incorporated at a level in the range from about 0.5% to about 30%, preferably from about 3% to about 20% by weight of composition. The detergent compositions herein generally contain in total from about 3% to about 60% preferably from about 12% to about 50%, more preferably from about 14% to about 30% of non-soap detersive, organic surfactant selected from anionic, nonionic, ampholytic, zwitterionic and cationic surfactants and mixtures thereof. Surfactants useful herein are listed in U.S. Pat. Nos. 4,222,905 and 4,239,659. Preferred detergent compositions comprise base granules constituting from about 30% to about 99.5% by weight of composition which in turn comprise from about 3% to about 30%, preferably from about 5% to about 20% by weight of composition of non-soap organic surfactant selected from anionic surfactants, cationic surfactants and mixtures thereof. The base granules will generally also contain a detergency builder as discussed below.

The anionic surfactant can be any one or more of the materials used conventionally in laundry detergents. Suitable synthetic anionic surfactants are water-soluble salts of alkyl benzene sulphonates, alkyl sulphates, alkyl polyethoxy ether sulphates, paraffin sulphonates, alpha-olefin sulphonates, alpha-sulpho-carboxylates and their esters, alkyl glyceryl ether sulphonates, fatty acid monoglyceride sulphates and sulphonates, alkyl phenol polyethoxy ether sulphates, 2-acyloxy alkane-1-sulphonate, and beta-alkyloxy alkane sulphonate.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups). Examples of this group of synthetic detergents are the sodium and potassium alkyl sulphates, especially those obtained by sulphating the $C_{8-18}$, preferably the $C_{10}$–$C_{16}$ fatty alcohols and sodium potassium alkyl benzene sulphonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

Other anionic detergent compounds herein include the sodium $C_{10-18}$ alkyl glyceryl ether sulphonates, especiallly those ethers of higher alcohols derived from tallow and coconut oil; sodium coconut oil fatty acid monoglyceride sulphonates and sulphates; and sodium or potassium salts of alkyl phenol ethylene oxide ether sulphate containing about 1 to about 10 units of ethylene oxide per molecule and wherein the alkyl groups contain about 8 to about 12 carbon atoms.

Other useful anionic detergent compounds herein include the water-soluble salts or esters of alpha-sulphonated fatty acids containing from about 6 to 20 carbon atoms in the fatty acid group and from about 1 to 10 carbon atoms in the ester group; water-soluble salts of 2-acyloxy-alkane-1-sulphonic acids containing from about 2 to 9 carbon atoms in the acyl group and from about 9 to about 23 carbon atoms in the alkane moiety; alkyl ether sulphates containing from about 10 to 18, especially about 10 to 16 carbon atoms in the alkyl group and from about 1 to 12, especially 1 to 6, more especially 1 to 4 moles of ethylene oxide; water-soluble salts of olefin sulphonates containing from about 12 to 24, preferably from about 14 to 16 carbon atoms, especially those made by reaction with sulphur trioxide followed by neutralization under conditions such that any sultones present are hydrolysed to the corresponding hydroxy alkane sulphonates; water-soluble salts of paraffin sulphonates containing from about 8 to 24, especially 14 to 16 carbon atoms, and beta-alkyloxy alkane sulphonates containing from about 1 to 3 carbon atoms, in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred.

Mixtures of anionic surfactants are particularly suitable herein, especially mixtures of sulfonate and sulfate surfactants in a weight ratio of from about 5:1 to about 1:5, preferably from about 5:1 to about 1:1, more preferably from about 5:1 to about 1.5:1. Especially preferred is a mixture of an alkyl benzene sulfonate having from 9 to 15, especially 11 to 13 carbon atoms in the alkyl radical, the cation being an alkali metal, preferably sodium; and either an alkyl sulfate having from 10 to 16 carbon atoms in the alkyl radical or an ethoxy sulfate having from 10 to 16 carbon atoms in the alkyl radical and an average degree of ethoxylation of 1 to 6, the cation being an alkali metal, preferably sodium.

The nonionic surfactants useful in the present invention both as detergent and as the second organic carrier component are condensates of ethylene oxide with a hydrophobic moiety to provide a surfactant having an average hydrophilic-lipophilic balance (HLB) in the range from about 9.5 to 13.5, preferably from about 10 to about 12.5. The hydrophobic moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 14 moles of ethylene oxide per mole of alkyl phenol. The alkyl substituent in such compounds may be derived, for example, from polymerised propylene, di-isobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 13 moles of ethylene oxide.
2. The condensation product of primary or secondary aliphatic alcohols having from 8 to 24 carbon atoms, in either straight chain or branched chain configuration, with from 2 to about 12 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade Name of BASF, Dobanol and Neodol being Trade Names of Shell), or Synperonics, which are understood to have about 50% 2-methyl branching (Synperonic as a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Cationic surfactants suitable for use herein include quaternary ammonium surfactants and surfactants of a semi-polar nature, for example amine oxides.

Suitable surfactants of the amine oxide class have the general formula VIII

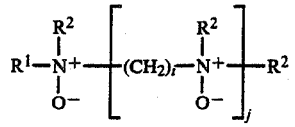

VIII wherein $R^1$ is a linear or branched alkyl or alkenyl group having 8 to 20 carbon atoms, each $R^2$ is independently selected from $C_{1-4}$ alkyl and $-(C_nH_{2n}O)_mH$ where i is an integer from 1 to 6, j is 0 or 1, n is 2 or 3 and m is from 1 to 7, the sum total of $C_nH_{2n}O$ groups in a molecule being no more than 7.

In a preferred embodiment $R^1$ has from 10 to 16 carbon atoms and each $R^2$ is independently selected from methyl and $-(C_nH_{2n}O)_mH$ wherein m is from 1 to 3 and the sum total of $C_nH_{2n}O$ groups in a molecule is no more than 5, preferably no more than 3. In a highly preferred embodiment, j is 0 and each $R^2$ is methyl, and $R^1$ is $C_{12}$–$C_{14}$ alkyl.

Suitable quaternary ammonium surfactants for use in the present composition can be defined by the general formula IX:

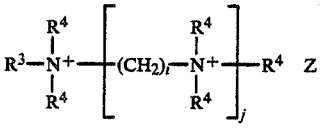

IX wherein $R^3$ is a linear or branched alkyl, alkenyl or alkaryl group having 10 to 16 carbon atoms and each $R^4$ is independently selected from $C_{1-4}$ alkyl, $C_{1-4}$ alkaryl and $-(C_nH_{2n}O)_m$ wherein i is an integer from 1 to 6, j is 0 or 1, n is 2 or 3 and m is from 1 to 7, the sum total of $C_nH_{2n}O$ groups in a molecule being no more than 7, and wherein Z represents counteranion in number to give electrical neutrality.

In a preferred embodiment, $R^3$ has from 10 to 14 carbon atoms and each $R^8$ is independently selected from methyl and $(C_nH_{2n}O)_mH$ wherein m is from 1 to 3 and the sum total of $C_nH_{2n}O$ groups in a molecule is no more than 5, preferably no more than 3. In a highly preferred embodiment j is 0, $R^4$ is selected from methyl, hydroxyethyl and hydroxypropyl and $R^3$ is $C_{12}$–$C_{14}$ alkyl. Particularly preferred surfactants of this class include $C_{12}$ alkyl trimethylammonium salts, $C_{14}$ alkyltrimethylammonium salts, coconutalkyltrimethylammonium salts, coconutalkyldimethyl-hydroxyethylammonium salts, coconutalkyldimethylhydroxypropylammonium salts, and $C_{12}$ alkyldihydroxyethylmethyl ammonium salts.

As mentioned previously, the suds-suppressor comnpositions are particularly advantageous in detergent compositions containing a high level of detersive surfactant (at least 12%) wherein the surfactant is based completely or in part on anionic or cationic surfactants having from 10 to 16 carbon atoms. In preferred compositions therefore, $C_{10-16}$ anionic and/or cationic surfactants constitute from about 5% to 100%, preferably from about 10% to about 50% by weight of the total detersive surfactant mixture.

In preferred embodiments, the detergent compositions of the invention also comprise from about 0.2% to 3%, preferably from about 0.5% to about 1.5% of $C_{16}$–$C_{24}$ fatty acid or fatty acid soap. This acts in combination with the suds-suppressor system to provide improved suds-suppression robustness.

Suitable fatty acid soaps can be selected from the ordinary alkali metal (sodium, potassium), ammonium, and alkylolammonium salts of fatty acids containing from about 16 to about 24 and preferably from about 18 to about 22 carbon atoms in the alkyl chain. Suitable fatty acids can be obtainef from natural sources such as, for instance, from soybean oil, castor oil, tallow, whale and fish oils, grease, lard and mixtures thereof). The fatty acids also can be synthetically prepared (e.g., by the oxidation of petroleum, or by hydrogenation of carbon monoxide by the Fischer-Tropsch process). Resin acids are suitable such as rosin and those resin acids in tall oil. Napthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil, as well as the free fatty acids themselves.

The detergent compositions of the invention can also contain up to about 90%, preferably from about 15% to about 60% of detergency builder. Suitable detergent builders useful herein can be of the polyvalent inorganic and polyvalent organic types, or mixtures thereof. Nonlimiting examples of suitable water-soluble, inorganic alkaline detergent builder salts include the alkali metal carbonates, sesquicarbonates, borates, phosphates, pyrophosphates, tripolyphosphates and bicarbonates. "Seeded carbonate" builders as disclosed in BE-A-798,856 are also suitable.

Examples of suitable organic alkaline detergency builder salts are water-soluble polycarboxylates such as the salts of nitrilotriacetic acid, lactic acid, glycollic acid and ether derivatives thereof as disclosed in BE-A-821,368, 821,369 and 821,370; succinic acid, malonic acid, (ethylenedioxy)diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propanetetracarboxylic acid and 1,1,2,3-propane tetracarboxylic acid; cyclopentane cis,cis,cis-tetracarboxylic acid, cyclopentadienide pentacarboxylic acid, 2,3,4,5-tetra hydrofuran-cis,cis,cis-tetracarboxylic acid, 2,5-tetra-hydro-furan-cis-di-carboxylic acid, 1,2,3,4,5,6-hexane-hexacarboxylic acid, mellitic acid, pyromellitic acid and the phthalic acid derivatives disclosed in GB-A-1,425,343.

Mixtures of organic and/or inorganic builders can be used herein. One such mixture of builders is disclosed in CA-A-755,038, e.g. a ternary mixture of sodium tripolyphosphate, trisodium nitrilotriacetate, and trisodium ethane-1-hydroxy-1,1-diphosphonate.

A further class of builder is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of GB-A-1,429,143, DE-A-2,433,485, and DE-A-2,525,778.

An alkali metal, or alkaline earth metal, silicate can also be present. The alkali metal silicate is preferably from about 3% to about 15%. Suitable silicate solids have a molar ratio of $SiO_2$/alkali metal$_2$O in the range from about 1.0 to about 3.3, more preferably from 1.5 to 2.0.

The compositions of the invention can be supplemented by all manner of detergent and laundering components, inclusive of bleaching agents, enzymes, fluorescers, photoactivators, soil suspending agents, anticaking agents, pigments, perfumes, fabric conditioning agents etc.

Enzymes suitable for use herein include those discussed in U.S. Pat. Nos. 3,519,570 and 3,533,139. Suitable fluorescers include Blankophor MBBH (Bayer AG) and Tinopal CBS and EMS (Ciba Geigy). Photoactivators are discussed in EP-A-57088, highly preferred materials being zinc phthalocynanine, tri- and tetra-sulfonates. Suitable fabric conditioning agents include smectite-type clays as disclosed in GB-A-1400898 and di-$C_{12}$–$C_{24}$ alkyl or alkenyl amines an ammonium salts.

Antiredeposition and soil suspension agents suitable herein include cellulose derivatives such as methylcellulose, carboxymethylcellulose and hydroxyethylcellulose, and homo- or co-polymeric polycarboxylic acids or their salts in which the polycarboxylic acid comprises at least two carboxyl radicals separated from each other by not more than two carbon atoms. Polymers of this type are disclosed in GB-A-1,596,756 incorporated herein by reference. Preferred polymers include copolymers or salts thereof of maleic anhydride with ethylene, methylvinyl ether, acrylic acid or methacrylic acid, the maleic anhydride constituting at least about 20 mole percent of the copolymer. These polymers are valuable for improving whiteness maintenance, fabric ash deposition, and cleaning performance on clay, proteinaceous and oxidizable soils in the presence of transition metal impurities.

Peroxygen bleaching agents suitable for use in the present compositions include hydrogen peroxide, inorganic peroxides, peroxy salts and hydrogen peroxide addition compounds, and organic peroxides and peroxy acids. Organic peroxyacid bleach precursors (bleach activators) can additionally be present.

Suitable inorganic peroxygen bleaches include sodium perborate mono- and tetrahydrate, sodium percarbonate, sodium persilicate, urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecanedioic acid, diperoxyazelaic acid, mono- and diperoxyphthalic acid and mono- and diperoxyisophthalic acid. Peroxyacid bleach precursors suitable herein are disclosed in UK-A-2040983, preferred being peracetic acid bleach precursors such as tetraacetylethylenediamine, tetraacetylmethylenediamine, tetracetylhexylenediamine, sodium p-acetoxybenzene sulphonate, tetraacetylglycouril, pentaacetylglucose, octaacetyllactose, and methyl O-acetoxy benzoate. The higher acyl derivatives disclosed in EP-A-98129 and European Patent Application No. 843010703 are also highly suitable, especially the $C_6$–$C_{10}$ acyl oxybenzene sulphonates and carboxylates such as sodium 3,5,5-trimethyl hexanoyl oxybenzene sulphonate. Bleach activators can be added at a weight ratio of bleaching agent to bleach activator in the range from about 40:1 to about 4:1.

In the Examples which follow, the abbreviations used have the following designations:

LAS: Linear $C_{11.8}$ alkyl benzene sulphonate.

TAE(n): Hardened tallow alcohol ethoxylated with n moles of ethylene oxide.

MAO: $C_{12}$–$C_{14}$ alkyl dimethylamine oxide.

AS: $C_{12\text{-}14}$ alcohol sulfate, sodium salt.

TAS: Tallow alcohol sulfate.

CATAB: Coconut alkyl trimethyl ammonium bromide.

Dobanol 45-E-7: A $C_{14\text{-}15}$ oxo-alcohol with 7 moles of ethylene oxide, marketed by Shell.

TAED: Tetraacetyl ethylene diamine.

Silicate: Sodium silicate having an $SiO_2{:}Na_2O$ ratio of 1.6:1.

Gantrez AN119: Trade Name for maleic anhydride/vinyl methyl ether co-polymer, believed to have an average molecular weight of about 240,000, marketed by GAF. This was prehydrolysed with NaOH before addition.

MA/AA: Copolymer of 1:4 maleic acid/acrylic acid, average molecular weight about 80,000.

Brightener: Disodium 4,4'-bis(2-morpholino-4anilino-s-triazino-6-ylamino)stilbene-2:2'-disulphonate.

Dequest 2060: Trade Name for diethylenetriaminepenta(methylenephosphonic acid), marketed by Monsanto.

Dequest 2041: Trade Name for ethylenediamine tetra(-methylenephosphonic acid)monohydrate, marketed by Monsanto.

INOBS: Sodium 3,5,5-trimethyl hexanoyl oxybenzene sulphonate.

Perborate: Sodium perborate tetrahydrate.

DC 198: Alkoxylated siloxane containing oxyethylene and oxypropylene groups, marketed by Dow Corning.

Silicone/Silica: 85:15 by weight high shear mix of polydimethylsiloxane and silanated silica, particle size 10 to 20 millimicrons, viscosity as indicated.

H.V. Silicone: Polydimethylsiloxane, viscosity 60,000 cs.

Enzyme: Protease.

The present invention is illustrated by the following non-limiting examples:

EXAMPLES I TO V

Granular detergent compositions are prepared as follows. A base powder composition is first prepared by mixing the indicated components in a crutcher as an aqueous slurry at a temperature of about 80° C. and containing about 35% water. The slurry is then spray dried at a gas inlet temperature of about 300° C. to form base powder granules. Suds suppressor composition is then prepared by premixing the silicone/silica high shear mix and the high viscosity silicone, adding the premix to a melt of the ethoxylated tallow alcohol, adding the silicone/silica dispersing agent and spraying the dispersion onto sodium tripolyphosphate in a fluidized bed. Finally, the base powder composition is dry mixed with suds suppressor, enzyme and bleach components, and additional nonionic surfactant and fatty acid, where present, are sprayed onto the total mixture.

All percentages are given by weight of total detergent composition.

| | EXAMPLES | | | | |
|---|---|---|---|---|---|
| | I | II | III | IV | V |
| BASE POWDER | | | | | |
| LAS | 6 | 4 | 10 | 5 | 8 |
| AS | 4 | 2 | 2 | 5 | — |
| MAO | — | — | — | — | 1 |
| CATAB | — | — | 2 | — | 1 |
| Gantrez AN119 | — | 1 | — | — | 1 |
| Silicate | 6 | 7 | 5 | 5 | 10 |
| Sodium carbonate | — | 8 | — | 13 | 5 |
| MA/AA | 0.5 | — | 1 | 2 | — |
| Brightener | 0.2 | 0.3 | 0.1 | 0.2 | 0.2 |
| Dequest 2060 | — | — | 0.3 | — | — |
| Dequest 2041 | 0.1 | 0.3 | — | 0.3 | 0.1 |
| EDTA | 0.2 | 0.3 | — | 0.2 | 0.2 |
| Sodium tripolyphosphate | 32 | 24 | 28 | 25 | 30 |
| Magnesium sulphate (ppm) | 1000 | — | 800 | 1000 | 1200 |
| Sodium sulphate, moisture & miscellaneous | | | to 100 | | |
| SUDS SUPPRESSOR | | | | | |
| TAE(25) | 0.6 | 0.37 | 0.5 | — | — |
| TAE(80) | — | — | — | 0.72 | 0.7 |
| PEG 6000 | — | — | 0.5 | — | — |
| H.V. Silicone | 0.3 | 0.25 | 0.25 | 0.18 | 0.28 |
| Silicone/silica (10,000 cs) | 0.3 | 0.12 | 0.25 | 0.18 | 0.14 |
| DC198 | 0.05 | 0.03 | 0.08 | 0.04 | 0.06 |
| Sodium tripolyphosphate | 1.75 | 1.55 | 3.42 | 1.88 | 2.32 |
| OTHER ADDITIVES | | | | | |
| Enzyme | 0.4 | — | 1.0 | 0.5 | 0.6 |
| Sodium perborate tetrahydrate | 24 | 12 | 14 | 21 | 22 |
| TAED | — | 2 | 1 | — | — |
| INOBS | 2 | — | — | 4 | — |
| Dobanol 45-E-7 | 5 | 10 | — | 2 | 4 |
| $C_{18-22}$ fatty acid | 1 | 1.5 | — | 1 | — |

The above products combine excellent detergency performance together with improved foam regulation characteristics across the range of wash temperature, product usage, soil, load and rinsing conditions.

EXAMPLES VI TO X

Granular detergent compositions are prepared as follows. Base powder compositions are first prepared as described in Examples I to V. Suds suppressor compositions are then prepared by mixing the first and second organic carrier components (TAE(80) and Dobanol 45-E-7 respectively) together with the siloxane-oxyalkylene copolymer dispersing agent, premixing the silicone/silica high shear mix and the high viscosity silicone, high shear mixing the premix with the organic carrier component, dry mixing the base powder compositions with enzyme and bleach components and spraying the suds suppressor compositions onto the total dry mix.

All percentages are given by weight of total composition.

| | EXAMPLES | | | | |
|---|---|---|---|---|---|
| | VI | VII | VIII | IX | X |
| BASE POWDER | | | | | |
| LAS | 5 | 12 | 7 | 10 | 5 |
| TAS | 5 | 1 | — | 1 | 1 |
| Gantrez AN119 | — | 1 | — | 0.8 | 1 |
| Silicate | 5 | 7 | 6 | 4 | 9 |
| MA/AA | 2 | — | 1 | 0.4 | — |
| Brightener | 0.2 | 0.3 | 0.1 | 0.5 | 0.2 |
| Dequest 2060 | — | — | 0.3 | 0.2 | — |
| Dequest 2041 | 0.3 | 0.3 | — | — | 0.1 |
| EDTA | 0.2 | 0.3 | — | 0.1 | 0.2 |
| Sodium tripolyphosphate | 23 | 24 | 32 | 32 | 30 |
| Sodium carbonate | 13 | — | 5 | 8 | — |
| Magnesium sulphate (ppm) | 1000 | — | 800 | — | 1200 |
| Sodium sulphate, moisture & miscellaneous | | | to 100 | | |
| SUDS SUPPRESSOR | | | | | |

-continued

| | EXAMPLES | | | | |
|---|---|---|---|---|---|
| | VI | VII | VIII | IX | X |
| COMPOSITION | | | | | |
| Dobanol 45-E-7 | 3.5 | 0.7 | 6 | 2 | 12 |
| TAE (80) | 0.5 | 0.5 | 1 | 0.4 | 1 |
| DC-198 | 0.03 | 0.033 | 0.35 | 0.02 | 0.05 |
| Silicone/Silica (6,500 cs) | 0.11 | 0.15 | 0.15 | 0.11 | 0.19 |
| HV Silicone | 0.22 | 0.15 | 0.2 | 0.11 | 0.38 |
| OTHER ADDITIVES | | | | | |
| Enzyme | 0.6 | — | 1.2 | — | 0.9 |
| Sodium perborate tetrahydrate | 20 | 12 | 15 | 28 | 22 |
| TAED | 0.5 | — | 1 | — | — |
| INOBS | 2.5 | — | — | 3.5 | — |

The above products combine excellent detergency performance together with improved foam regulation characteristics across the range of wash temperature, product usage, soil, load and rinsing conditions.

What is claimed is:

1. A process for preparing a suds suppressor composition, said process comprising the steps of (a) forming a high shear mix of polydimethylsiloxane and hydrophobic silica suds suppressing agents in a weight ratio of polydimethylsiloxane to hydrophobic silica in the range from 75:25 to about 99:1, the polydimethylsiloxane having a viscosity at 25° C. in the range from about 20 to about 12,500 cs, (b) forming a dispersion of (i) the product of step (a) and (ii) polydimethylsiloxane suds suppressing agent having a viscosity at 25° C. of at least about 25,000 cs in (iii) a water-soluble or water-dispersible organic carrier, the combination of (i) and (ii) having a viscosity at 25° C. of at least about 18,000 cs, said water-soluble or water-dispersible organic carrier comprising from about 1% to 100% by weight of a first organic carrier component having a melting point in the range from about 38° C. to about 90° C., and from 0% to about 99% by weight of a second organic carrier component selected from the group consisting of ethoxylated nonionic surfactants having a hydrophilic-lipophilic balance (HLB) in the range from about 9.5 to about 13.5 and a melting point in the range from about 5° C. to about 36° C.

2. A process as recited in claim 1 wherein step (b) comprises blending the product of step (a) and the polydimethylsiloxane having a viscosity at 25° C. of at least about 25,000 cs to form a premix which is said combination having a viscosity at 25° C. of at least about 18,000 cs, and dispersing said premix in said water-soluble or water-dispersible organic carrier.

3. A process as recited in claim 2 wherein in step (b) the polydimethylsiloxane suds suppressing agent having a viscosity at 25° C. of at least about 25,000 cs has a viscosity at 25° of from about 50,000 to about 100,000 cs and said combination having a viscosity at 25° C. of from about 25,000 to about 60,000 cs.

4. A process as recited in claim 3 wherein the product of step (a) and the polydimethylsiloxane suds suppressing agent having a viscosity at 25° C. of from about 50,000 to about 100,000 cs are in a weight ratio of from about 4:1 to about 1:4.

5. A process as recited in claim 4 wherein the first organic carrier component comprises an ethoxylated nonionic surfactant having an HLB in the range from about 15 to about 19, and a melting point in the range from about 38° C. to 60° C. and said carrier comprises from about 1% to about 50% by weight of the first carrier component and from about 50% to about 99% by weight of the second carrier component, thereby to produce a stable sprayable composition.

6. A process recited in claim 5 wherein silicone-oxyalkylene copolymer dispersing agent is added in step (b).

* * * * *